US012016414B2

(12) United States Patent
Yoshida

(10) Patent No.: US 12,016,414 B2
(45) Date of Patent: Jun. 25, 2024

(54) ARTIFICIAL HAIR, HEAD DECORATION PRODUCT INCLUDING SAME, AND ARTIFICIAL HAIR PRODUCTION METHOD

(71) Applicant: KANEKA CORPORATION, Osaka (JP)

(72) Inventor: Naoto Yoshida, Osaka (JP)

(73) Assignee: KANEKA CORPORATION, Osaka (JP)

( * ) Notice: Subject to any disclaimer, the term of this patent is extended or adjusted under 35 U.S.C. 154(b) by 1035 days.

(21) Appl. No.: 16/958,320

(22) PCT Filed: Dec. 11, 2018

(86) PCT No.: PCT/JP2018/045519
§ 371 (c)(1),
(2) Date: Jun. 26, 2020

(87) PCT Pub. No.: WO2019/131117
PCT Pub. Date: Jul. 4, 2019

(65) Prior Publication Data

US 2021/0059335 A1 Mar. 4, 2021

(30) Foreign Application Priority Data

Dec. 27, 2017 (JP) ..... 2017-251785

(51) Int. Cl.
*D02G 3/44* (2006.01)
*A41G 3/00* (2006.01)
(Continued)

(52) U.S. Cl.
CPC ..... *A41G 3/0083* (2013.01); *A41G 3/0075* (2013.01); *A41G 5/004* (2013.01);
(Continued)

(58) Field of Classification Search
CPC .... A41G 3/0083; A41G 3/0075; A41G 5/004; D02G 3/045; D02G 3/44; D10B 2321/041; D10B 2331/04; A61Q 5/00
(Continued)

(56) References Cited

U.S. PATENT DOCUMENTS 3,987,162 A * 10/1976 Scheuermann ..... A61Q 5/12 510/427
5,916,547 A * 6/1999 Torgerson ..... C08G 77/442 424/70.12
(Continued)

FOREIGN PATENT DOCUMENTS

CN 1500706 A 6/2004
JP H11-279035 A 10/1999
(Continued)

OTHER PUBLICATIONS

International Search Report issued in International Application No. PCT/JP2018/045519, mailed Feb. 26, 2019 (2 pages).
(Continued)

*Primary Examiner* — Matthew D Matzek
(74) *Attorney, Agent, or Firm* — Osha Bergman Watanabe & Burton LLP

(57) ABSTRACT

Provided is artificial hair including chemical fibers and a fiber treatment composition that is adhered to the surfaces of the chemical fibers. The fiber treatment composition may include an oxazoline group-containing acrylic resin and an organic-modified silicone oil. The oxazoline group-containing acrylic resin may have a main chain that includes a (meth)acrylic acid ester and styrene.

12 Claims, 1 Drawing Sheet

(51) Int. Cl.
*A41G 5/00* (2006.01)
*D02G 3/04* (2006.01)

(52) U.S. Cl.
CPC ..... *D02G 3/045* (2013.01); *D02G 3/44* (2013.01); *D10B 2321/041* (2013.01); *D10B 2331/04* (2013.01)

(58) Field of Classification Search
USPC ..... 428/364
See application file for complete search history.

(56) References Cited

U.S. PATENT DOCUMENTS

| | | | |
|---|---|---|---|
| 6,380,338 | B1 | 4/2002 | Witteler et al. |
| 6,497,864 | B1 | 12/2002 | Samain et al. |
| 2004/0042974 | A1 | 3/2004 | Dupuis et al. |

FOREIGN PATENT DOCUMENTS

| | | | | |
|---|---|---|---|---|
| JP | 2000-136216 | A | | 5/2000 |
| JP | 2012-162520 | A | | 8/2012 |
| JP | 2015-071832 | A | | 4/2015 |
| JP | 2015071832 | A | * | 4/2015 |
| JP | 2015-094050 | A | | 5/2015 |
| JP | 5735552 | B2 | | 6/2015 |

OTHER PUBLICATIONS

Written Opinion issued in International Application No. PCT/JP2018/045519, mailed Feb. 26, 2019 (4 pages).

* cited by examiner

ARTIFICIAL HAIR, HEAD DECORATION PRODUCT INCLUDING SAME, AND ARTIFICIAL HAIR PRODUCTION METHOD

TECHNICAL FIELD

The present invention relates to artificial hair that can be used as an alternative to human hair, hair ornaments including the same, and a method for producing artificial hair.

BACKGROUND ART

Not only human hair but also artificial hair has been used in hair ornaments such as hairpieces, hair wigs, hair extensions, hair bands, and doll hair. Various synthetic fibers and collagen fibers have been used as the artificial hair. Examples of the synthetic fibers include polyvinyl chloride fibers, polyester fibers, modacrylic fibers, and polyamide fibers. Examples of the collagen fibers include regenerated collagen fibers. To improve the touch and the combing property of the artificial hair such as synthetic fibers, fiber treatment agents have been adopted. For example, Patent Document 1 proposes applying a treatment agent including acrylic resin particles and aminosilicone dispersed in a main dispersion medium to the surfaces of synthetic fibers to improve the combing property and the touch of the fibers. Patent Document 2 proposes adhering a treatment agent including acrylic resin and amino-modified silicone to polypropylene fibers to improve the touch, the combing property, etc., of the fibers.

PRIOR ART DOCUMENTS

Patent Documents

Patent Document 1: JP 5735552
Patent Document 2: JP 2015-071832 A

DISCLOSURE OF INVENTION

Problem to be Solved by the Invention

Hair ornaments such as hairpieces are often used for a long period of time. Such a long period of use considerably deteriorates the combing property, i.e., the combing durability of the hair ornaments. Conventional artificial hairs including artificial hairs described in Patent Documents 1 and 2 have been demanded to improve the combing durability.

In order to solve the above conventional problem, the present invention provides artificial hair having a smooth touch and good combing durability hair ornaments including the same, and a method for producing artificial hair.

Means for Solving Problem

The present invention relates to artificial hair, including: chemical fibers; and a fiber treatment composition that is adhered to surfaces of the chemical fibers. The fiber treatment composition contains an oxazoline group-containing acrylic resin and an organic-modified silicone oil. The oxazoline group-containing acrylic resin has a main chain containing a (meth)acrylic acid ester and styrene.

It is preferred that the content of the styrene in the oxazoline group-containing acrylic resin is 0.3 to 55% by weight. It is preferred that the content of the (meth)acrylic acid ester in the oxazoline group-containing acrylic resin is 25 to 87% by weight. It is preferred that, in the oxazoline group-containing acrylic resin, the total content of the (meth)acrylic acid ester and the styrene is 80 to 87.3% by weight, and the content of an oxazoline group-containing component is 12.7 to 20% by weight.

It is preferred that the chemical fibers include one or more selected from the group consisting of polyvinyl chloride fibers, acrylic fibers, and polyester fibers. It is preferred that the organic-modified silicone oil includes one or more selected from the group consisting of an amino-modified silicone oil and an epoxy-modified silicone oil.

The fiber treatment composition may further contain a polyalkylene oxide-based compound. The fiber treatment composition may further contain a quaternary ammonium salt.

It is preferred that the content of the fiber treatment composition in the artificial hair is 0.05 to 0.35% by weight on a solid basis. It is preferred that the content of the oxazoline group-containing acrylic resin in the artificial hair is 0.02 to 0.2% by weight. It is preferred that the content of the organic-modified silicone oil in the artificial hair is 0.03 to 0.3% by weight on a nonvolatile basis.

The present invention also relates to hair ornaments including the artificial hair.

The present invention also relates to a method for producing artificial hair including chemical fibers, the method including: adhering a fiber treatment composition to surfaces of the chemical fibers. The fiber treatment composition contains an oxazoline group-containing acrylic resin and an organic-modified silicone oil. The oxazoline group-containing acrylic resin has a main chain containing a (meth)acrylic acid ester and styrene.

Effects of the Invention

The present invention provides artificial hair having a smooth touch and good combing durability and hair ornaments including the same. Further, the method for producing artificial hair of the present invention provides artificial hair including synthetic fibers that has a smooth touch and good combing durability.

DESCRIPTION OF THE INVENTION

Figure 1A:
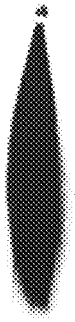
FIG. 1 illustrates a method for measuring the combing durability.

The present inventors have conducted earnest studies to solve the above problem. As a result, it was found that artificial hair having a smooth touch and good combing durability can be obtained by using an oxazoline group-containing acrylic resin having a main chain containing a (meth)acrylic acid ester and styrene in combination with an organic-modified silicone oil, as fiber treatment agents to be adhered to the surfaces of chemical fibers such as synthetic fibers.

The chemical fibers may be one or more selected from the group consisting of synthetic fibers and collagen fibers. Examples of the synthetic fibers include, but are not particularly limited to, polyvinyl chloride fibers, polyester fibers, acrylic fibers, and polyamide fibers. Examples of the collagen fibers include regenerated collagen fibers.

As the polyvinyl chloride fibers, fibers constituted by polyvinyl chloride can be used. The polyvinyl chloride may be a homopolymer of vinyl chloride, or a copolymer of vinyl chloride and another copolymerizable monomer. Examples of the another copolymerizable monomer include, but are not particularly limited to, vinyl esters such as vinyl acetate and vinyl propionate; acrylic acid esters such as butyl acrylate and 2-ethylhexyl acrylate; and olefins such as ethylene and propylene. In terms of fiber properties and transparency a homopolymer of vinyl chloride, a vinyl chloride-ethylene copolymer, a vinyl chloride-vinyl acetate copolymer, and the like, are suitably used. The content of the another copolymerizable monomer in the copolymer is not particularly limited, and can be determined appropriately depending on the purpose.

The polyvinyl chloride fibers may contain a heat stabilizer from the viewpoint of spinning stability. Examples of the heat stabilizer include, but are not particularly limited to, a tin-based heat stabilizer, a Ca—Zn-based heat stabilizer a hydrotalcite-based heat stabilizer, an epoxy-based heat stabilizer, and a ß-diketone-based heat stabilizer. The heat stabilizers may be used individually or in combination of two or more. The blending amount of the heat stabilizer may be, but is not particularly limited to, 0.2 to 5 parts by weight with respect to 100 parts by weight of the polyvinyl chloride.

The polyvinyl chloride fibers may contain a lubricant from the viewpoint of spinning stability Examples of the lubricant include, but are not particularly limited to, a metallic soap lubricant, a polyethylene lubricant, a higher fatty acid lubricant, an ester lubricant, and a higher alcohol lubricant. The lubricants may be used individually or in combination of two or more. The blending amount of the lubricant may be, but is not particularly limited to, 0.2 to 5 parts by weight with respect to 100 parts by weight of the polyvinyl chloride.

The polyvinyl chloride fibers may contain a heat resistance improver from the viewpoint of heat resistance. Examples of the heat resistance improver include, but are not particularly limited to, chlorinated polyvinyl chloride and AS resin (a copolymer of acrylonitrile and styrene). The chlorinated polyvinyl chloride may be produced by reacting polyvinyl chloride as a raw material with chlorine to increase the chlorine content of the polyvinyl chloride to 58 to 72% by weight. The heat resistance improvers may be used individually or in combination of two or more. The blending amount of the heat resistance improver may be, but is not particularly limited to, 1 to parts by weight with respect to 100 parts by weight of the polyvinyl chloride.

The polyvinyl chloride fibers may optionally contain known compounding agents such as a stabilizing aid, a plasticizer, an ultraviolet absorber, an antioxidant, an antistatic agent, a filler, a flame retardant, and a pigment, as required. In some cases, the polyvinyl chloride fibers may contain known special compounding agents such as a foaming agent, a crosslinker, a tackifier, a conductivity imparting agent, and a fragrance.

The polyester fibers are preferably but are not particularly limited to, fibers produced by melt-spinning a polyester-based resin composition that includes: one or more polyesters selected from the group consisting of polyalkylene terephthalate and copolymerized polyesters containing 80 mol % or more of polyalkylene terephthalate; a bromine-containing flame retardant; and an antimony-based compound, from the viewpoint of flame retardancy.

The polyalkylene terephthalate is preferably but is not particularly limited to, polyethylene terephthalate, polypropylene terephthalate, or polybutylene terephthalate, from the viewpoint of availability and cost.

The bromine-containing flame retardant is preferably, but is not particularly limited to, a bromine-containing phosphate-based flame retardant, a brominated polystyrene-based flame retardant, a brominated benzylacrylate-based flame retardant, a brominated epoxy-based flame retardant, a brominated phenoxy resin-based flame retardant, a brominated polycarbonate-based flame retardant, a tetrabromobisphenol A derivative, a bromine-containing triazine based compound, and a bromine-containing isocyanuric acid compound, from the viewpoint of imparting the flame retardancy to the fibers. The bromine-containing flame retardant is more preferably a bromine-containing phosphate-based flame retardant, a brominated epoxy-based flame retardant, and a brominated phenoxy resin-based flame retardant, and further preferably a brominated epoxy-based flame retardant, from the viewpoint of fiber properties, heat resistance, and stability in processing. The bromine-containing flame retardants may be used individually or in combination of two or more. The blending amount of the bromine-containing flame retardant may be, e.g., to 30 parts by weight, or 6 to 25 parts by weight with respect to 100 parts by weight of polyester.

Examples of the antimony compound include, but are not particularly limited to, antimony trioxide, antimony tetroxide, antimony pentoxide, and sodium antimonate. The antimony compounds may be used individually or in combination of two or more. The blending amount of the antimony compound may be, e.g., 0.5 to 10 parts by weight, or 0.6 to 9 parts by weight with respect to 100 parts by weight of polyester-based resin.

The polyester fibers may contain various additives such as a heat resistant agent, a light stabilizer, a fluorescer, an antioxidant, an antistat, a pigment, a plasticizer, and a lubricant, as required.

The polyamide fibers may be, but are not particularly limited to, fibers produced by melt-spinning a polyamide-based resin composition containing polyamide. Examples of the polyamide include homopolymers, copolymers, and mixtures of nylon 6, nylon 66, nylon 46, nylon 69, nylon 610, nylon 612, nylon 11, nylon 12, and polymethaxylylene adipamide (nylon MXD6). Among these, polyamides containing 80 mol % or more of nylon 6 and/or nylon 66 are preferred from the viewpoint of heat resistance. Similarly to the polyester fibers, the polyamide fibers preferably contain a bromine-based flame retardant and an antimony compound from the viewpoint of flame retardancy.

The polyamide fibers may contain various additives such as a heat resistant agent, a light stabilizer, a fluorescer, an antioxidant, an antistat, a pigment, a plasticizer, and a lubricant, as required.

The polyvinyl chloride fibers, the polyester fibers, and the polyamide fibers can be produced by conventionally known methods. For example, first, polyvinyl chloride, polyester, or polyamide, and various compounding agents as required, are melt-kneaded using a single-screw extruder, a twin-screw extruder a roll, a Banbury mixer, a kneader or the like, and the mixture is pelletized by conventionally known methods to prepare a pelletized polyvinyl chloride-based resin composition, polyester based resin composition, or polyamide-based resin composition. The pelletized resin composition is melt-spun by a general melt spinning method to produce undrawn yarns. Then, the undrawn yarns can be subjected to drawing. The drawing may be either a two-step method or a direct spinning-drawing method. In the two-step method, the undrawn yarns are once wound, and then drawn. In the direct spinning-drawing method, the undrawn yarns are drawn continuously without winding. Hot drawing may be performed by a single-stage drawing method or a multi-stage drawing method including two or more stages.

As the acrylic fibers, fibers constituted by an acrylic polymer can be used. The acrylic polymer may be, but is not particularly limited to, an acrylic polymer including 35 to 75% by weight of acrylonitrile, 25 to 65% by weight of a halogen-containing vinyl monomer, and 0 to 10% by weight of another vinyl monomer copolymerizable with these, from the viewpoint of flame retardancy. Examples of the halogen-containing vinyl monomer include, but are not particularly limited to, vinyl chloride, vinylidene chloride, vinyl bromide, and vinylidene bromide. The halogen-containing vinyl monomers may be used individually or in combination of two or more. The another vinyl monomer may be, e.g., a sulfonic acid-containing monomer. Examples of the sulfonic acid-containing monomer include, but are not particularly limited to, allylsulfonic acid, methallylsulfonic acid, styrenesulfonic acid, isoprenesulfonic acid, 2-acrylamido-2-methylpropanesulfonic acid, as well as metal salts, such as sodium salts, and amine salts of these. The another vinyl monomers may be used individually or in combination of two or more.

The acrylic fibers can be produced by conventionally known methods. For example, the acrylic fibers can be produced by wet-spinning a spinning solution in which the acrylic polymer is dissolved in an organic solvent. Examples of the organic solvent include dimethyl sulfoxide (DMSO), dimethylacetamide (DMA), and N,N-dimethylformamide (DMF).

The regenerated collagen fibers are not particularly limited, and known regenerated collagen fibers can be used. The regenerated collagen fibers can be produced by dissolving and solubilizing a collagen raw material and spinning the solubilized collagen solution, for example.

The single fiber fineness of the chemical fibers such as synthetic fibers and collagen fibers is preferably 10 to 150 dtex, more preferably 30 to 120 dtex, and further preferably 40 to 100 dtex, from the viewpoint of suitability as artificial hair.

A fiber treatment composition is adhered to the surfaces of the chemical fibers such as synthetic fibers and collagen fibers. The fiber treatment composition contains an oxazoline group-containing acrylic resin and an organic-modified silicone oil.

The oxazoline group-containing acrylic resin has a main chain containing a (meth)acrylic acid ester and styrene. Such an oxazoline group-containing acrylic resin is obtained through copolymerization of a monomer having an oxazoline group, a (meth)acrylic acid ester, and styrene, as essential monomer components. In one or more embodiments of the present invention, "(meth)acrylic acid" means acrylic acid and/or methacrylic acid. Further, in one or more embodiments of the present invention, "(meth)acrylic acid ester" means an acrylic acid ester and/or a methacrylic acid ester.

Examples of the monomer having an oxazoline group include, but are not particularly limited to, addition polymerizable oxazolines such as 2-vinyl-2-oxazoline, 2-vinyl-4-methyl-2-oxazoline, 2-vinyl-5-methyl-2-oxazoline, 2-isopropenyl-2-oxazoline, 2-isopropenyl-4-methyl-2-oxazoline, and 2-isopropenyl-5-ethyl-2-oxazoline. These may be used individually or in combination of two or more. Among these, 2-isopropenyl-2-oxazoline is suited in terms of industrial availability.

The (meth)acrylic acid ester may be either a methacrylic acid ester or an acrylic acid ester. Examples of the (meth) acrylic acid ester include, but are not particularly limited to, methacrylic acid esters such as methyl methacrylate, ethyl methacrylate, n-butyl methacrylate, isobutyl methacrylate, t-butyl methacrylate, 2-ethylhexyl methacrylate, methoxypolyethylene glycol methacrylate, lauryl methacrylate, stearyl methacrylate, 2-hydroxyethyl methacrylate, 2-hydroxypropyl methacrylate, monoesters of methacrylic acid and polyethylene glycol, and 2-aminoethyl methacrylate and salts thereof and acrylic acid esters such as methyl acrylate, ethyl acrylate, butyl acrylate, 2-ethylhexyl acrylate, stearyl acrylate, perfluoroalkylethyl acrylate, phenyl acrylate, 2-hydroxyethyl acrylate, 2-aminoethyl acrylate and salts thereof methoxypolyethylene glycol acrylate, lauryl acrylate, 2-hydroxypropyl acrylate, and monoesters of acrylic acid and polyethylene glycol. These may be used individually or in combination of two or more.

The oxazoline group-containing acrylic resin may contain another acrylic monomer in addition to the monomer having an oxazoline group, the (meth)acrylic acid ester, and the styrene, as long as they do not interfere with the effects of the present invention. Examples of the another acrylic monomer include acrylic monomers such as (meth)acrylonitrile, acrylamide, and N-(hydroxymethyl)acrylamide.

The content of the styrene in the oxazoline group-containing acrylic resin is preferably 0.3 to 55% by weight, and more preferably 27 to 55% by weight. The content of the (meth)acrylic acid ester in the oxazoline group-containing acrylic resin is preferably 25 to 87% by weight, and more preferably 25 to 57% by weight. It is preferred that, in the oxazoline group-containing acrylic resin, the total content of the (meth)acrylic acid ester and the styrene is 80 to 87.3% by weight, and the content of an oxazoline group-containing component is 12.7 to 20% by weight. When the contents of the (meth)acrylic acid ester and the styrene in the oxazoline group-containing acrylic resin are within the above range, the combing durability improves. In one or more embodiments of the present invention, the contents of the (meth) acrylic acid ester and the styrene in the oxazoline group-containing acrylic resin can be measured by NMR analysis and alkalinolysis GC-MS, respectively, as described later.

The glass transition temperature (Tg) of the oxazoline group-containing acrylic resin is preferably but is not particularly limited to, −50° C. or more and more preferably 50° C. or more, from the viewpoint of improving the combing durability. In one or more embodiments of the present invention, the glass transition temperature can be measured by differential scanning calorimetry (DSC), for example.

The oxazoline group-containing acrylic resin may be used in an emulsion state dispersed in water or the like. As such an emulsion in which the oxazoline group-containing acrylic resin is dispersed in water or the like, a commercially available product can be used appropriately.

The organic-modified silicone oil may be any silicone in which part of methyl groups of dimethyl silicone oil is substituted with an organic functional group. For example, from the viewpoint of improving the touch and the combing property, the organic-modified silicone oil is preferably an amino-modified silicone oil, an epoxy-modified silicone oil, and the like. The amino-modified silicone oil is an oil in which part of methyl groups of organochlorosilane is substituted with an amino group. The amino group may be monoamine ($—R^1—NH_2$) or diamine ($—R^1—NH—R^2—NH_2$). $R^1$ and $R^2$ may be an alkyl group with 1 to 6 carbon atoms or an alkylene group with 1 to 6 carbon atoms. The amine equivalent weight of the amino-modified silicone oil is desirably but is not particularly limited to, in a range of 500 or more and less than 4000, from the viewpoint of easily imparting smoothness to synthetic fibers. Further, the weight average molecular weight of the amino-modified silicone oil is preferably 5000 to 200000, more preferably 5000 to 170000, and further preferably 5000 to 150000 from the viewpoint of improving the touch and the combing durability of the artificial hair fibers. The organic-modified silicone oil such as the amino-modified silicone oil may be a commercially available product in an aqueous emulsion state or an aqueous solution state blended with water, an emulsifier, or the like.

The fiber treatment composition may contain dimethyl silicone oil in addition to the organic-modified silicone oil. The viscosity of the dimethyl silicone oil is preferably but is not particularly limited to, 10,000 to 50,000,000 $mm^2/s$, and more preferably 20,000 to 1,000,000 mm/s, from the viewpoint of further improving the combing property and the touch. In one or more embodiments of the present invention, the viscosity of the dimethyl silicone oil is a kinematic viscosity (mm/s) at 25° C. measured in accordance with ASTM D 445-46T using an Ubbelohde viscometer. The dimethyl silicone oil may be a commercially available product in an aqueous emulsion state or an aqueous solution state blended with water, an emulsifier, or the like.

The fiber treatment composition may further contain a polyalkylene oxide-based compound. The polyalkylene oxide-based compound imparts antistatic properties to artificial hair. The polyalkylene oxide-based compound is preferably but is not particularly limited to, a copolymer of ethylene oxide and propylene oxide. The addition polymerization of alkylene oxide can be carried out in accordance with a known method, and it may be a random type or a block type. The weight average molecular weight of the polyalkylene oxide-based compound is preferably 2000 to 25000, and more preferably 5000 to 20000 from the viewpoint of the touch and the antistatic properties.

The fiber treatment composition may further contain a quaternary ammonium salt. The quaternary ammonium salt imparts antistatic properties to artificial hair. Examples of the quaternary ammonium salt include stearyltrimethylammonium chloride, octadecyltrimethylammonium chloride, and dodecyltrimethylammonium chloride.

The fiber treatment composition may further contain an aqueous medium. The fiber treatment agents such as the oxazoline group-containing acrylic resin, organic-modified silicone oil, dimethyl silicone oil, polyalkylene oxide-based compound, and quaternary ammonium salt described above may be dispersed or dissolved in an aqueous medium. The aqueous medium is preferably water, and examples thereof include distilled water, ion-exchanged water, and ultrapure water.

In the fiber treatment composition, the weight ratio of the oxazoline group-containing acrylic resin to the organic-modified silicone oil (nonvolatile content) may be, but is not particularly limited to, 1:9 to 1:27, from the viewpoint of easy adhesion of the fiber treatment agents to chemical fibers. In the fiber treatment composition, the content of the dimethyl silicone oil (nonvolatile content) may be, but is not particularly limited to, 48 to 144 parts by weight with respect to 100 parts by weight of the oxazoline group-containing acrylic resin, from the viewpoint of easy adhesion of the fiber treatment agents to chemical fibers. In the fiber treatment composition, the content of the polyalkylene oxide-based compound may be, but is not particularly limited to, 130 to 390 parts by weight with respect to 100 parts by weight of the oxazoline group-containing acrylic resin, from the viewpoint of easy adhesion of the fiber treatment agents to chemical fibers. In the fiber treatment composition, the content of the quaternary ammonium salt may be, but is not particularly limited to, 54 to 162 parts by weight with respect to 100 parts by weight of the oxazoline group-containing acrylic resin, from the viewpoint of easy adhesion of the fiber treatment agents to synthetic fibers.

The adhesion method of the fiber treatment composition to the chemical fibers is not particularly limited, and for example, the adhesion may be immersion of synthetic fibers in the fiber treatment composition, spraying of the fiber treatment composition on the surfaces of synthetic fibers, or winding of synthetic fibers around a roll on which the fiber treatment composition is applied. After that, drying may be performed at 30 to 50° C. for 1 to 3 hours as required. Then, heat treatment may be performed at 80 to 150° C. for 2 to 10 minutes under tension. It is also possible to perform the adhesion of the fiber treatment composition after chemical fibers are processed into hair ornaments.

The artificial hair contains the fiber treatment composition in an amount of preferably 0.05% by weight or more, and more preferably 0.1% by weight or more on a solid basis. Further, the artificial hair contains the fiber treatment composition in an amount of preferably 0.35% by weight or less, and more preferably 0.25% by weight or less on a solid basis. More specifically, the artificial hair contains the fiber treatment composition in an amount of preferably 0.05 to 0.25% by weight, and more preferably 0.1 to 0.2% by weight on a solid basis. When the content of the fiber treatment composition in the artificial hair is within the above range, the touch and the combing durability improve. The content of the fiber treatment composition (solid content) in the artificial hair can be measured in the manner described later. The solid content includes the nonvolatile content of the organic-modified silicone oil (in some cases, the solid content includes the nonvolatile contents of the organic-modified silicone oil and the dimethyl silicone oil).

The artificial hair contains the oxazoline group-containing acrylic resin in an amount of preferably 0.02 to 0.2% by weight. When the content of the oxazoline group-containing acrylic resin in the artificial hair is within the above range, the touch and the combing durability improve. The content of the oxazoline group-containing acrylic resin in the artificial hair can be measured in the manner described later.

The artificial hair contains the organic-modified silicone oil in an amount of preferably 0.03 to 0.3% by weight on a nonvolatile basis. When the content of the organic-modified silicone oil in the artificial hair is within the above range, the touch and the combing durability improve. The content of the organic-modified silicone oil can be measured in the manner described later.

The artificial hair contains the dimethyl silicone oil in an amount of preferably 0.015 to 0.045% by weight on a nonvolatile basis. When the content of the dimethyl silicone oil in the artificial hair is within the above range, the touch and the combing durability improve. The content of the dimethyl silicone oil can be measured in the manner described later.

The artificial hair contains the polyalkylene oxide-based compound in an amount of preferably 0.0148 to 0.0444% by weight from the viewpoint of improving antistatic properties.

The artificial hair contains the quaternary ammonium salt in an amount of preferably 0.009 to 0.027% by weight from the viewpoint of improving antistatic properties.

The average friction coefficient (MIU) of the artificial hair measured using KES-SE friction tester (manufactured by KATO TECH CO., LTD.) is preferably 0.20 or less, more preferably 0.18 or less, and further preferably 0.15 or less from the viewpoint of smoothing the touch. The average friction coefficient is measured in the manner described later.

The artificial hair withstands the number of times of shaking of preferably 50 times or more, more preferably 55 times or more, further preferably 60 times or more, still further preferably 65 times or more, and even further preferably 70 times or more from the viewpoint of excellent combing durability. The number of times of shaking is measured in the manner described later.

Hair ornaments can be formed using the artificial hair. Examples of the hair ornaments include hair wigs, hairpieces, weavings, hair extensions, braided hair, hair accessories, and doll hair.

The hair ornaments may be formed only of the above-mentioned artificial hair. The hair ornaments may also be formed by combining the above-mentioned artificial hair with another synthetic fibers (e.g., polyvinyl chloride fibers, polyester fibers, polyamide fibers, acrylic fibers), collagen fibers (e.g., regenerated collagen fibers), natural fibers (e.g., human hair, animal hair), etc.

EXAMPLES

Hereinafter, the present invention will be described in more detail based on examples. However, the present invention is not limited to the examples.

The following fiber treatment agents were used.

Fiber treatment agent 1: Emulsion of oxazoline group-containing acrylic resin (solvent: water, 40% by weight), the oxazoline group-containing acrylic resin having a main chain containing butyl acrylate and styrene, and containing 25% by weight of the butyl acrylate, 55% by weight of the styrene, and 20% by weight of the oxazoline group-containing component Fiber treatment agent 2: Emulsion of oxazoline group-containing acrylic resin (solvent: water, 40% by weight), the oxazoline group-containing acrylic resin having a main chain containing butyl acrylate and styrene, and containing 57% by weight of the butyl acrylate, 27% by weight of the styrene, and 16% by weight of the oxazoline group-containing component Fiber treatment agent 3: Emulsion of oxazoline group-containing acrylic resin (solvent: water, 40% by weight), the oxazoline group-containing acrylic resin having a main chain containing butyl acrylate and styrene, and containing 87% by weight of the butyl acrylate, 0.3% by weight of the styrene, and 12.7% by weight of the oxazoline group-containing component Fiber treatment agent 4: Amino-modified silicone oil (weight average molecular weight: 120000, emulsion, solvent: water, 10% by weight)

Fiber treatment agent 5: Dimethyl silicone oil (emulsion, solvent: water viscosity: 100000 $mm^2/s$, 55% by weight)

Fiber treatment agent 6: Polyalkylene oxide-based compound (copolymer of ethylene oxide and propylene oxide, weight average molecular weight: 20000, emulsion, solvent: water, 20% by weight)

Fiber treatment agent 7: Quaternary ammonium salt (emulsion, solvent: water, 29% by weight)

Fiber treatment agent 8: Amino-modified silicone oil (emulsion, 50% by weight)

Fiber treatment agent 9: Emulsion of oxazoline group-containing acrylic resin (solvent: mixed solvent of water and 1-methoxy-2-propanol, 39% by weight), the oxazoline group-containing acrylic resin having a main chain composed of ethyl acrylate and methyl methacrylate, and containing 1.67% by weight of the ethyl acrylate, 34.7% by weight of the methyl methacrylate, and 63.6% by weight of the oxazoline group-containing component Fiber treatment agent 10: Acrylic resin (emulsion, solvent: water, "DS-36" manufactured by YOSHIMURA OIL CHEMICAL Co., Ltd., 50% by weight, product equivalent to "FH-45" manufactured by YOSHIMURA OIL CHEMICAL Co., Ltd.), the amount of styrene in the acrylic resin being too small to be quantified by gel $^1$HNMR analysis Fiber treatment agent 11: Amino-modified silicone oil (weight average molecular weight: 13000, emulsion, solvent: water, 40% by weight)

(Composition Analysis of Fiber Treatment Agent)

The compositions of the fiber treatment agents 1-3 and 9 (active component: oxazoline group-containing acrylic resin) and the composition of the fiber treatment agent 10 (active component: acrylic resin) were measured through pyrolysis GC-MS analysis, and the (meth)acrylic acid ester and the styrene were quantified by gel $^1$HNMR analysis and alkalinolysis GC-MS, respectively. First, 2 g of each fiber treating agent was ultra-centrifuged (30,000 rpm×1 hour×2 times) to obtain the oxazoline group-containing acrylic resin or acrylic resin as a sample. Next, the sample was subjected to pyrolysis GC-MS analysis, gel $^1$HNMR analysis, and alkalinolysis GC-MS analysis under the following measurement conditions. The alkalinolysis was performed by heating (80° C., 3 hours) the sample in a saturated KOHO solution.

<Pyrolysis GC-MS Analysis>

(a) Instrument G: "6890N" manufactured by Agilent Technologies, Inc. MS: "5973N" manufactured by Agilent Technologies, Inc.
(b) Column: Agilent J&W DB-5MS, 0.25 mmφ×30 m (0.25 μm)
(c) Column temperature: 35° C. (5 min)→10° C./min→290° C. (19.5 min)
(d) Carrier gas: helium, 1 mL/min
(e) Injection method: split (1:50)
(f) Inlet temperature: 290° C.
(g) Interface temperature: 290° C.
(h) Measured mass range: m/z 29 to 700
(i) Pyrolyzer: "JCI-22" manufactured by Japan Analytical Industry Co., Ltd.
(j) Pyrolysis temperature: 590° C.×5 sec <Gel $^1$HNMR Analysis>

(a) The sample was swollen by deuterated chloroform containing 1,1,2,2-tetrachloroethane (TCE) as an internal standard.
(b) The swollen sample was subjected to $^1$HNMR analysis using 2400 Hz magic angle spinning.

<Alkalinolysis GC-MS Measurement Conditions>

(a) Instrument G: "6890N" manufactured by Agilent Technologies, Inc. MS: "5973N" manufactured by Agilent Technologies, Inc.
(b) Column: SUPELCOWAX, 0.25 mmφ×30 m (0.25 μm)
(c) Column temperature: 37° C. (2 min)→5° C./min→100° C. (19.5 min)→10° C./min→280° C. (1.4 min)
(d) Carrier gas: helium, 1 mL/min
(e) Injection method: splitless, 0.5 min
(f) Inlet temperature: 280° C.
(g) Interface temperature: 280° C.
(h) Measured mass range: m/z 29 to 700

Example 1

<Spinning Process>

1.4 parts by weight of a vinyl chloride-vinyl acetate copolymer (trade name "K1F" manufactured by KANEKA CORPORATION), 0.9 parts by weight of a plasticizer, 1.1 parts by weight of a heat stabilizer, 2.93 parts by weight of a processing aid, and 0.88 parts by weight of a lubricant were added to 100 parts by weight of a vinyl chloride homopolymer (trade name "S-1001" manufactured by KANEKA CORPORATION), and mixed and stirred by a Henschel mixer to obtain a polyvinyl chloride-based resin compound. The compound was introduced into a hopper part of a single screw extruder (bore diameter: 40 mm), and extruded and melt-spun at a cylinder temperature of 170° C. and a nozzle temperature in a range of 180±15° C. The nozzle hole had a cocoon-like shape. The extruded filaments were subjected to heat treatment for about 0.5 to 1.5 seconds in a heating cylinder (330° C., atmosphere) disposed under the nozzle. The undrawn yarns after heat treatment were wounded around a bobbin by a take-up roll. Then, the undrawn yarns were drawn to about two to four times the original length through a hot air circulation box in which the temperature was adjusted at 110° C. The drawn yarns were continuously subjected to 38% relaxation treatment in the hot air circulation box adjusted at 110° C., and the multi-filaments were wound up to obtain polyvinyl chloride fibers (single fiber fineness: about 72 dtex).

<Adhesion Process of Fiber Treatment Composition>

(1) A fiber treatment composition a was prepared by mixing the fiber treatment agents 1, 4, 5, 6 and 7 with pure water in the proportion indicated in Table 1 below.

(2) 300 g of the fiber treatment composition a was poured into a disposable cup, in which 25 g of the polyvinyl chloride fibers were immersed for 5 minutes (bath ratio 1:12).

(3) The polyvinyl chloride fibers were squeezed to a squeezing ratio of 24% to drop the fiber treatment composition a from the fibers.

(4) Then, the squeezed fibers were dried at 40° C. for 2 hours.

(5) The dried fibers were fixed in a tensed state, and subjected to heat treatment at 120° C. for 5 minutes.

(6) After air cooling, the tension was released, and the fibers were combed.

Example 2

The fiber treatment composition was adhered to the polyvinyl chloride fibers in the same manner as in Example 1 except for the use of a fiber treatment composition b prepared by mixing the fiber treatment agents 2, 4, 5, 6, and 7 with pure water in the proportion indicated in Table 1.

Example 3

The fiber treatment composition was adhered to the polyvinyl chloride fibers in the same manner as in Example 1 except for the use of a fiber treatment composition c prepared by mixing the fiber treatment agents 3, 4, 5, 6, and 7 with pure water in the proportion indicated in Table 1.

Example 4

The fiber treatment composition was adhered to the polyvinyl chloride fibers in the same manner as in Example 1 except for the use of a fiber treatment composition h prepared by mixing the fiber treatment agents 1, 5, 6, 7 and 11 with pure water in the proportion indicated in Table 1.

Example 5

The fiber treatment composition was adhered to the polyvinyl chloride fibers in the same manner as in Example 1 except for the use of a fiber treatment composition i prepared by mixing the fiber treatment agents 1, 4, 5, 6, and 7 with pure water in the proportion indicated in Table 1.

Example 6

The fiber treatment composition was adhered to the polyvinyl chloride fibers in the same manner as in Example 1 except for the use of a fiber treatment composition j prepared by mixing the fiber treatment agents 1 and 4 with pure water in the proportion indicated in Table 1.

Comparative Example 1

The fiber treatment composition was adhered to the polyvinyl chloride fibers in the same manner as in Example 1 except for the use of a fiber treatment composition d prepared by mixing the fiber treatment agents 1, 5, 6, and 7 with pure water in the proportion indicated in Table 1.

Comparative Example 2

The fiber treatment composition was adhered to the polyvinyl chloride fibers in the same manner as in Example 1 except for the use of a fiber treatment composition e prepared by mixing the fiber treatment agents 4, 5, 6, and 7 with pure water in the proportion indicated in Table 1.

Comparative Example 3

The fiber treatment composition was adhered to the polyvinyl chloride fibers in the same manner as in Example 1 except for the use of a fiber treatment composition f prepared by mixing the fiber treatment agents 4, 5, 6, 7 and 9 with pure water in the proportion indicated in Table 1.

Comparative Example 4

The fiber treatment composition was adhered to the polyvinyl chloride fibers in the same manner as in Example 1 except for the use of a fiber treatment composition g prepared by mixing the fiber treatment agents 8 and 10 with pure water in the proportion indicated in Table 1.

TABLE 1

| Blending ratio (parts by weight) | Fiber treatment composition | | | | | | | | | |
|---|---|---|---|---|---|---|---|---|---|---|
| | a | b | c | d | e | f | g | h | i | j |
| Pure water | 100 | 100 | 100 | 100 | 100 | 100 | 100 | 100 | 100 | 100 |
| Fiber treatment agent 1 | 0.3 | — | — | 0.3 | — | — | — | 0.3 | 1.5 | 0.3 |
| Fiber treatment agent 2 | — | 0.3 | — | — | — | — | — | — | — | — |
| Fiber treatment agent 3 | — | — | 0.3 | — | — | — | — | — | — | — |
| Fiber treatment agent 4 | 2.5 | 2.5 | 2.5 | — | 2.5 | 2.5 | — | — | 12.5 | 2.5 |
| Fiber treatment agent 5 | 0.13 | 0.13 | 0.13 | 0.13 | 0.13 | 0.13 | — | 0.13 | 0.13 | — |

TABLE 1-continued

| Blending ratio (parts by weight) | Fiber treatment composition | | | | | | | | | |
|---|---|---|---|---|---|---|---|---|---|---|
| | a | b | c | d | e | f | g | h | i | j |
| Fiber treatment agent 6 | 0.35 | 0.35 | 0.35 | 0.35 | 0.35 | 0.35 | — | 0.35 | 0.35 | — |
| Fiber treatment agent 7 | 0.15 | 0.15 | 0.15 | 0.15 | 0.15 | 0.15 | — | 0.15 | 0.15 | — |
| Fiber treatment agent 8 | — | — | — | — | — | — | 0.3 | — | — | — |
| Fiber treatment agent 9 | — | — | — | — | — | 0.3 | — | — | — | — |
| Fiber treatment agent 10 | — | — | — | — | — | — | 0.3 | — | — | — |
| Fiber treatment agent 11 | — | — | — | — | — | — | — | 0.625 | — | — |

The adhesion amount of the fiber treatment composition (solid content), the average friction coefficient, the combing durability in the fibers of Examples and Comparative Example were measured and evaluated as follows. Table 2 below shows the results.

(Adhesion Amount of Fiber Treatment Composition on a Solid Basis)

2 g of fibers was immersed in 30 g of a mixed solvent of ethanol:cyclohexane=1:1 (weight ratio) (manufactured by FUJIFLIM Wako Pure Chemical Corporation) to dissolve the fiber treatment composition. Only the solvent was extracted and vaporized from the dissolved material of the fiber treatment composition, and the remaining fiber treatment composition (solid) was weighed. Next, the fiber treatment composition was dissolved in THF (tetrahydrofuran) to analyze the dissolved material with a gas chromatograph ("GC6890N" manufactured by Agilent Technologies, Inc.), and MS spectra of detected peaks were matched to library spectra to specify various fiber treatment agent components in the fiber treatment composition (solid) and to measure the contents of the various fiber treatment agent components (solid content). Then, the adhesion amount of the fiber treatment composition and the adhesion amounts of the various fiber treatment agent components on a solid basis were calculated by Formulae below. When the various fiber treatment agent components and their contents in the solid of the fiber treatment composition are previously known, the adhesion amounts of the various fiber treatment agent components (solid content) can be calculated based on Formula below, only by measuring the weight of the fiber treatment composition (solid content) in the fibers. The solid content of the organic-modified silicone oil or dimethyl silicone oil means the nonvolatile content of the organic-modified silicone oil or dimethyl silicone oil, respectively. In Examples 1-6 and Comparative Examples 2-3, the solid content of the fiber treatment composition includes the nonvolatile contents of the organic-modified silicone oil and the dimethyl silicone oil. In Comparative Example 1, the solid content includes the nonvolatile content of the dimethyl silicone oil. In Comparative Example 4, the solid content includes the nonvolatile content of the organic-modified silicone oil.

Adhesion amount (% by weight) of fiber treatment composition (solid content)=[(Weight of solid content of fiber treatment composition/Weight of fibers]×100

Adhesion amount (% by weight) of various fiber treatment agent components (solid content)=[(Weight of solid content of fiber treatment composition×Contents of various fiber treatment agent components in the solid content of fiber treatment composition)/Weight of fibers]×100

(Average Friction Coefficient)

An artificial hair sample 1 (fiber length: 30 cm, weight: 4 g) was fixed on a stage of KES-SE friction tester (manufactured by KATO TECH CO., LTD.), while an artificial hair sample 2 (fiber length: 12 cm, weight: 0.8 g) was attached to a friction element (contact). The sample 1 and the sample 2 were rubbed against each other under conditions of a sliding velocity of 4 mm/s and a static weight of 75 g to measure a friction coefficient. The friction coefficient was measured twice and averaged.

(Combing Durability)

Figure 1B:
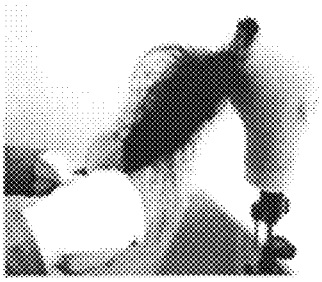
Figure 1C:
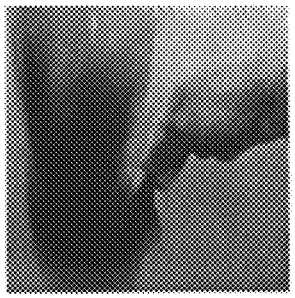

Preparation of sample: 15 g of 24 inch long fibers were bundled. The fiber bundle was adjusted to 28 inch long by intentionally displacing the fibers by 4 inch using a hackling. Then, the fiber bundle was tied in the middle with a string, and folded in two to prepare a 14 inch long sample for combing durability measurement. Next, the sample was sprayed uniformly with an artificial finger fat solution (product name "Artificial finger fat solution" manufactured by HAYASHI PURE CHEMICAL IND., LTD.) in an amount of 6.7% omf (% on mass of fibers), and dried at 40° C. for 2 hours to prepare a sample after application of the artificial finger fat solution as shown in FIG. 1A. Thereafter, the end of the sample tied with the string was fixed to a mannequin as shown in FIG. 1B, and the sample was rubbed with hands twice to give the sample the same degree of damage as in the case of wearing a hair ornament such as a hairpiece for along period of about two weeks. Next, the damaged sample was shaken with hand as shown in FIG. 1C to measure the number of times of shaking at which the sample could no longer be hand-combed (the number of times of shaking). The sample with the larger number of times of shaking means that the sample is less likely to tangle and has high combing durability. The sample with the number of times of shaking of 50 times or more in both of two measurements was judged as acceptable.

TABLE 2

| Adhesion amount of fiber treatment agent on a solid basis (% by weight) | Example | | | | | | Comparative Example | | | |
|---|---|---|---|---|---|---|---|---|---|---|
| | 1 | 2 | 3 | 4 | 5 | 6 | 1 | 2 | 3 | 4 |
| Fiber treatment composition | 0.10 | 0.10 | 0.10 | 0.10 | 0.37 | 0.067 | 0.10 | 0.10 | 0.10 | 0.10 |
| Fiber treatment agent 1 | 0.022 | — | — | 0.022 | 0.11 | 0.022 | 0.039 | — | — | — |
| Fiber treatment agent 2 | — | 0.022 | — | — | — | — | — | — | — | — |

TABLE 2-continued

| Adhesion amount of fiber treatment agent on a solid basis (% by weight) | Example 1 | Example 2 | Example 3 | Example 4 | Example 5 | Example 6 | Comparative Example 1 | Comparative Example 2 | Comparative Example 3 | Comparative Example 4 |
|---|---|---|---|---|---|---|---|---|---|---|
| Fiber treatment agent 3 | — | — | 0.022 | — | — | — | — | — | — | — |
| Fiber treatment agent 4 | 0.045 | 0.045 | 0.045 | — | 0.225 | 0.045 | — | 0.057 | 0.045 | — |
| Fiber treatment agent 5 | 0.013 | 0.013 | 0.013 | 0.013 | 0.013 | — | 0.023 | 0.016 | 0.013 | — |
| Fiber treatment agent 6 | 0.013 | 0.013 | 0.013 | 0.013 | 0.013 | — | 0.023 | 0.016 | 0.013 | — |
| Fiber treatment agent 7 | 0.008 | 0.008 | 0.008 | 0.008 | 0.008 | — | 0.014 | 0.010 | 0.008 | — |
| Fiber treatment agent 8 | — | — | — | — | — | — | — | — | — | 0.05 |
| Fiber treatment agent 9 | — | — | — | — | — | — | — | — | 0.022 | — |
| Fiber treatment agent 10 | — | — | — | — | — | — | — | — | — | 0.05 |
| Fiber treatment agent 11 | — | — | — | 0.045 | — | — | — | — | — | — |
| Average friction coefficient ($\times 10^{-2}$) | 0.122 | 0.121 | 0.145 | 0.177 | 0.168 | 0.138 | 0.272 | 0.184 | 0.228 | 0.198 |
| The number of times of shaking (times) | 75/70 | 60/55 | 60/55 | 55/60 | 55/60 | 50/50 | 35/40 | 45/45 | 50/45 | 40/50 |

The results of Table 2 indicates that the artificial hairs of Examples 1-6, to which the oxazoline group-containing acrylic resin having a main chain containing a (meth)acrylic acid ester and styrene and the organic-modified silicone oil had been adhered, resulted in a small average friction coefficient and the number of times of shaking of 50 times or more, and thus had a smooth touch and good combing durability. The comparison between Examples 1-3 indicates that, when the content of the styrene in the oxazoline group-containing acrylic resin was high, the average friction coefficient was likely to be small, and the combing durability was likely to improve. Further, the comparison between Examples 1 and 4 indicates that, when the weight average molecular weight of the organic-modified silicone oil was high, the average friction coefficient was likely to be small, and the combing durability was likely to improve.

Meanwhile, the artificial hair of Comparative Example 1, to which the organic-modified silicone oil had not been adhered, resulted in a large average friction coefficient and the number of times of shaking of less than 50 times, and thus had a poor touch and poor combing durability. The artificial hair of Comparative Example 2, to which the oxazoline group-containing acrylic resin had not been adhered, resulted in the number of times of shaking of less than 50 times, and thus had poor combing durability. The artificial hair of Comparative Example 3, to which the oxazoline group-containing acrylic resin had been adhered but the main chain of the oxazoline group-containing acrylic resin did not contain styrene, resulted in a large average friction coefficient and the number of times of shaking of less than 50 times in one of two measurements, and thus had a poor touch and poor combing durability. The artificial hair of Comparative Example 4 using the treating agents having the same composition as that of Example 1 of Patent Document 1 in which an acrylic resin not containing styrene was used, resulted in the number of times of shaking of less than 50 times in one of two measurements, and thus had poor combing durability.

The invention claimed is:

1. Artificial hair, comprising:

chemical fibers; and a fiber treatment composition that is adhered to the surfaces of the chemical fibers, wherein the fiber treatment composition comprises an oxazoline group-containing acrylic resin and an organic-modified silicone oil, and the oxazoline group-containing acrylic resin has a main chain comprising a (meth)acrylic acid ester and styrene, the oxazoline group-containing acrylic resin contains the styrene in an amount of 27 to 55% by weight, contains the (meth)acrylic acid ester in an amount of 25 to 57% by weight, contains the (meth)acrylic acid ester and the styrene in a total amount of 80 to 84% by weight, and contains an oxazoline group-containing component in an amount of 16 to 20% by weight, and the fiber treatment composition further comprises a copolymer of ethylene oxide and propylene oxide.

2. The artificial hair according to claim 1, wherein the chemical fibers comprise one or more selected from the group consisting of polyvinyl chloride fibers, acrylic fibers, and polyester fibers.

3. The artificial hair according to claim 1, wherein the organic-modified silicone oil comprises one or more selected from the group consisting of an amino-modified silicone oil and an epoxy-modified silicone oil.

4. The artificial hair according to claim 1, wherein the fiber treatment composition further comprises a quaternary ammonium salt.

5. The artificial hair according to claim 1, wherein the artificial hair contains the fiber treatment composition in an amount of 0.05 to 0.35% by weight on a solid basis.

6. The artificial hair according to claim 1, wherein the artificial hair contains the oxazoline group-containing acrylic resin in an amount of 0.02 to 0.2% by weight.

7. The artificial hair according to claim 1, wherein the artificial hair contains the organic-modified silicone oil in an amount of 0.03 to 0.3% by weight on a nonvolatile basis.

8. A hair ornament comprising the artificial hair according to claim 1.

9. A method for producing artificial hair that comprises chemical fibers, comprising:

adhering a fiber treatment composition to the surfaces of the chemical fibers, wherein the fiber treatment composition comprises an oxazoline group-containing acrylic resin and an organic-modified silicone oil, and the oxazoline group-containing acrylic resin has a main chain comprising a (meth)acrylic acid ester and styrene, the oxazoline group-containing acrylic resin contains the styrene in an amount of 27 to 55% by weight, contains the (meth)acrylic acid ester in an amount of 25 to 57% by weight, contains the (meth)acrylic acid ester and the styrene in a total amount of 80 to 84% by weight, and contains an oxazoline group-containing component in an amount of 16 to 20% by weight, and the fiber treatment composition further comprises a copolymer of ethylene oxide and propylene oxide.

10. The artificial hair according to claim 1, wherein the chemical fibers comprise polyvinyl chloride fibers, and wherein the polyvinyl chloride fibers contain the fiber treatment composition in an amount of 0.05 to 0.35% by weight on a solid basis.

11. The hair ornament according to claim 8, wherein the chemical fibers comprise polyvinyl chloride fibers, and wherein the polyvinyl chloride fibers contain the fiber treatment composition in an amount of 0.05 to 0.35% by weight on a solid basis.

12. The method according to claim 9, wherein the chemical fibers comprise polyvinyl chloride fibers, and wherein the polyvinyl chloride fibers contain the fiber treatment composition in an amount of 0.05 to 0.35% by weight on a solid basis.

* * * * *